US006497278B1

(12) United States Patent
Norris

(10) Patent No.: US 6,497,278 B1
(45) Date of Patent: Dec. 24, 2002

(54) CIRCULATION CONTROL DEVICE

(75) Inventor: Robert M. Norris, Dorset (GB)

(73) Assignee: Varco I/P, Houston, TX (US)

( * ) Notice: Subject to any disclaimer, the term of this patent is extended or adjusted under 35 U.S.C. 154(b) by 53 days.

(21) Appl. No.: 09/810,275

(22) Filed: Mar. 19, 2001

(51) Int. Cl.[7] ..... E21B 17/00; E21B 17/18

(52) U.S. Cl. ..... 166/242.3; 166/66.6; 166/332.8

(58) Field of Search ..... 166/66.6, 66.4, 166/105.4, 313, 242.3, 332.8, 117.5, 373, 330

(56) References Cited

U.S. PATENT DOCUMENTS 3,731,742 A * 5/1973 Sizer et al. ..... 137/629
4,378,051 A * 3/1983 Cholet et al. ..... 166/113
4,434,847 A * 3/1984 Vazquez et al. ..... 166/117.5
4,579,177 A * 4/1986 Going, III ..... 137/629
4,798,247 A * 1/1989 Deaton et al. ..... 166/66.6
5,975,209 A * 11/1999 McCorry ..... 166/242.3
6,227,299 B1 * 5/2001 Dennistoun ..... 137/515

* cited by examiner

*Primary Examiner*—David Bagnell
*Assistant Examiner*—T. Shane Bomar
(74) *Attorney, Agent, or Firm*—Finnegan, Henderson, Farabow, Garrett & Dunner LLP

(57) ABSTRACT

A control device for regulating flow of fluid selectively with respect to two passages of a completion tool positioned within well bore tubing. The device incorporates a valve that is electrically driven to selectively block to prevent fluid flow through one of two passages of a Y-tool. The device operates to prevent recirculation of product fluid when an electrical submersible pump (ESP) is operating and alternately closes this passage with respect to fluid flow when the pump is not operating to permit intervention work within the well bore below the location of the ESP.

7 Claims, 7 Drawing Sheets

CIRCULATION CONTROL DEVICE

BRIEF DESCRIPTION OF THE INVENTION

The present invention relates to a control device which is electrically operated to selectively direct fluid flow through a completion tool within a well bore.

BACKGROUND OF THE INVENTION

The use of an electrical submersible pump (ESP) in a well is common practice, as is the use of an associated bypass system. The bypass system permits access to the well below the ESP so that logging operations and other intervention work may be performed. In this application, typically a bypass string depends from one limb of a bifurcated tubing of a completion tool, such as a Y-tool, with a second limb containing the ESP. Both limbs communicate with the production tubing of the well bore extending to the surface. In practice, one bypass limb is sealed during production of fluid from the well by installing either a blanking plug or a device that relies solely on differential pressure to prevent recirculation of the fluid from the ESP discharge via the bypass limb of the completion tool and back to the well. This requires periodic installation and removal of the plug which is time consuming, thus adding significantly to the overall cost of the operation. The use of devices relying on pressure differential are unreliable which results in possible loss of fluid passing through the device and returning to the well during production.

It is accordingly a primary object of the invention to provide a control completion tool positioned within a well bore wherein removable plugs are not required and positive control and positioning of the sealing element maybe obtained.

SUMMARY OF THE INVENTION

In accordance with the invention, a control device is provided for regulating flow of fluid selectively with respect to two passages of a completion tool positioned within well bore tubing. The completion tool has a first passage in which an electrical submersible pump is positioned to pump fluid through the first passage and to a surface portion of the completion tool through which said fluid passes to the well bore tubing and then to the surface and thereof. The completion tool has a second passage connected to the surface portion of the completion tool which second passage bypasses the first passage and the electrical submersible pump therein. A valve is provided having an arrangement for selectively closing the second passage to fluid flow therethrough when the pump is pumping fluid through the first passage to the surface portion and simultaneously opening the first passage to fluid flow therethrough, and opening the second passage to fluid flow therethrough when the pump is not pumping said fluid and simultaneously closing the first passage to fluid flow therethrough. In this manner the pump maybe bypassed through the open second passage to gain access to the well bore below the location of the pump to permit various intervention work to be performed.

The valve may include a rotatable shaft to which means for simultaneously closing the second passage and opening the first passage and selectively opening the second passage and closing the first passage is connected.

The control device may further include means for selectively closing the second passage and opening the first passage, and selectively opening the second passage and closing the first passage that includes a plate connected to the rotatable shaft and adapted for alternate and selective sealing engagement with the first passage and second passage for closing thereof to fluid flow therethrough.

The valve may include means for opening both the first passage and the second passage simultaneously.

Means maybe provided for moving the plate to a position where both the first passage and second passage are simultaneously open.

DETAILED DESCRIPTION OF THE PREFERRED EMBODIMENTS

Figure 1:
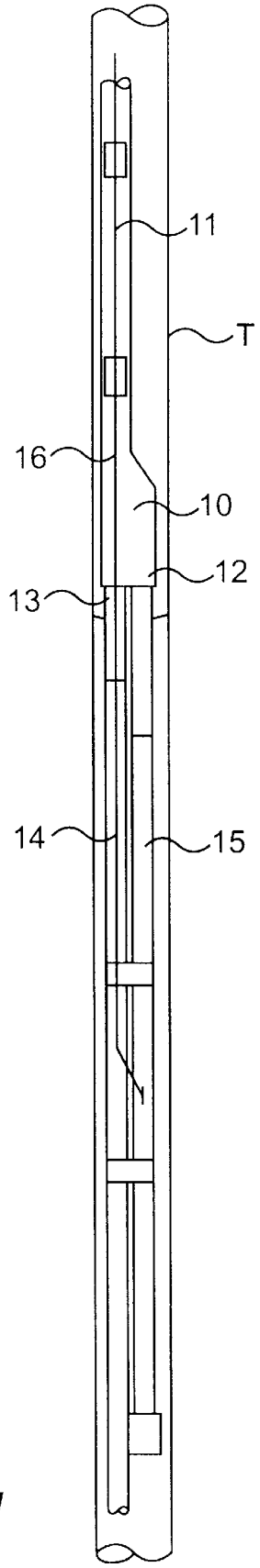
FIG. 1 is a sectional view of the control device positioned within a well bore tubing.

With reference to the drawings, and for the present to FIG. 1 thereof, a completion Y-tool 10 is positioned within well bore tubing T. The tool 10 has a surface portion 11 thereof through which fluid product from the well may pass to the surface. From this surface portion 11 of the tool 10 lower limbs 12 and 13 depend. Limb 13 is a bypass limb that is connected to the bypass tubing 14. And ESP 15 is mounted within the limb 12.

Figure 2:
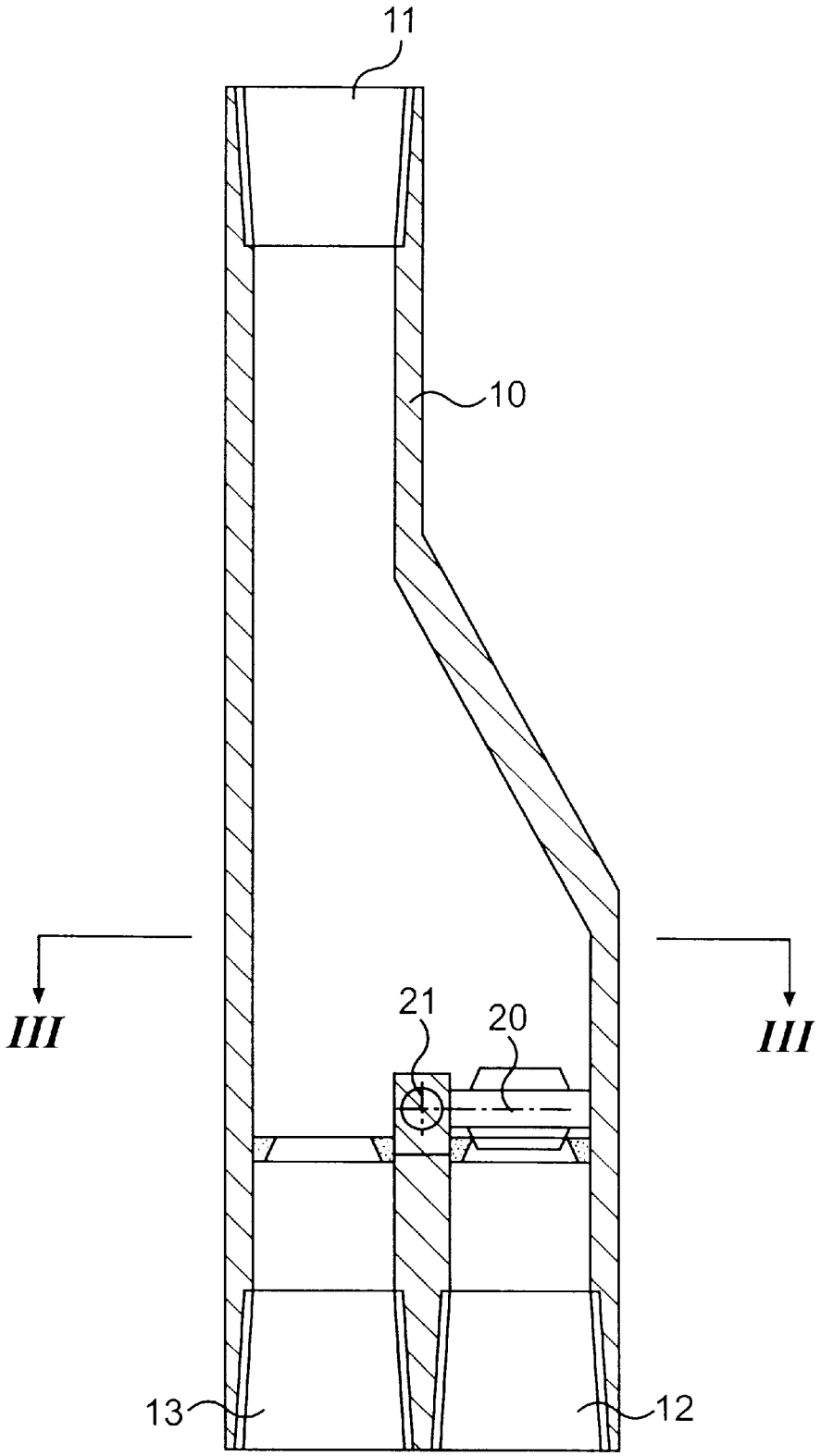
FIG. 2 is a detailed sectional view of the valve assembly of the control device.
Figure 3:
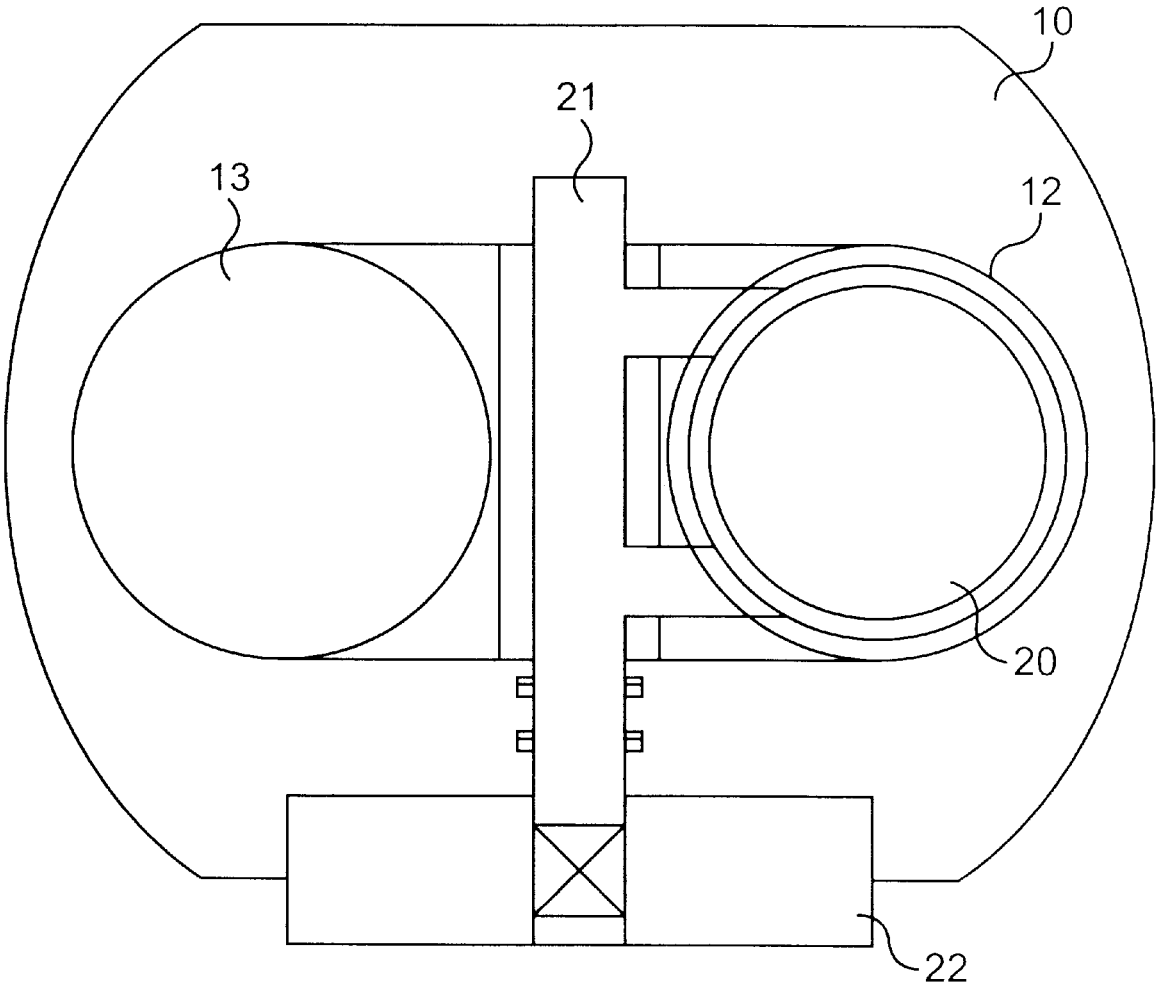
FIG. 3 is a sectional view of the valve assembly of FIG. 2 taken along III—III thereof.

As best shown in FIGS. 2 and 3, the tool 10 has a valve 20 that is positioned on a rotatable shaft 21 at the junction of the tube limbs 12 and 13. By rotation of shaft 21 the directional valve 20 may be selectively positioned to close either one of the limbs 12 and 13. The shaft 21 is rotated by an electrical motor 22. Other devices maybe used to rotate the shaft, such as a coil-type solinoide.

Figure 4:
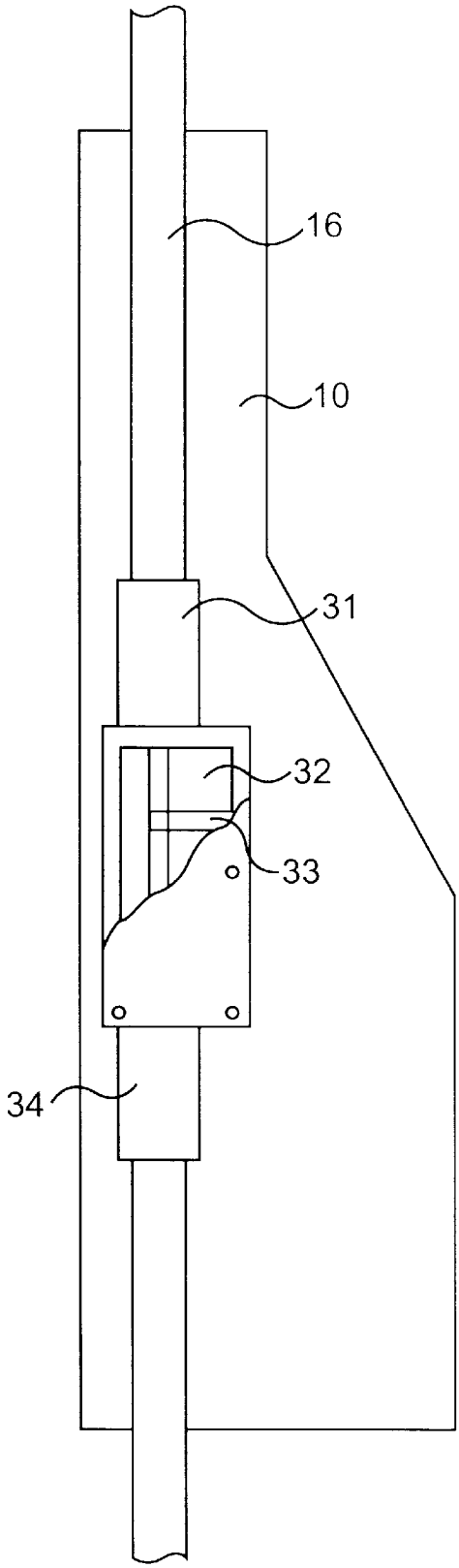
FIG. 4 is an elevational view with parts broken away to show a system for providing electrical power to the valve for operation thereof.

As shown in FIG. 4, the electrical power to drive the device 22 will be taken from the electrical cable 16 which is used to supply power to the ESP 15. Any conventional arrangement may be used for this purpose. An example of a suitable arrangement is shown in FIG. 4 wherein power cable 16 with bulk head type connection 31 is connected within a pressure proof chamber 32. The power is there divided as required within the chamber 32 with one connection 33 to the electric motor 22 and the other which is the main cable 16 exiting the chamber 32 through the bulk head type connection 34 and extending therefrom to the ESP 15.

Figure 5:
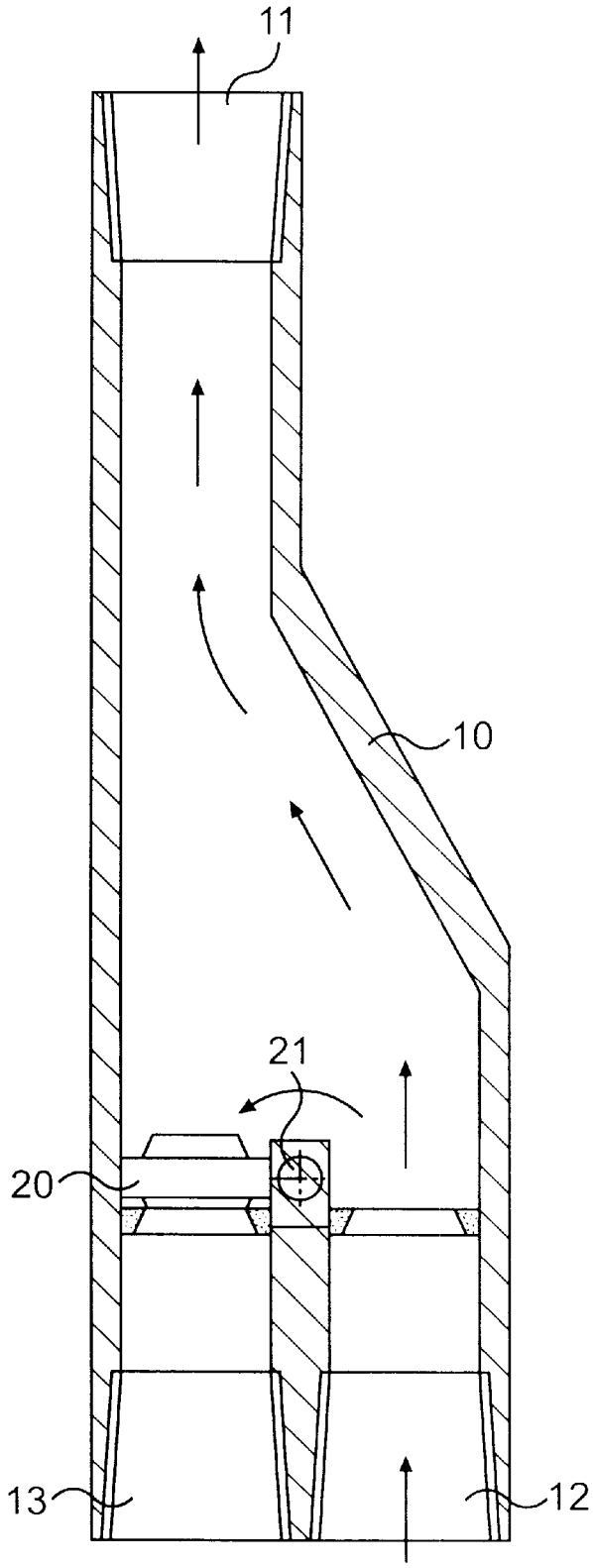
FIG. 5 is a sectional view of the valve assembly with the valve in the normal operating position wherein fluid product is pumped through the limb of the device with the pump in operation.

With respect to the operation of the device, reference is made to FIG. 5. When electrical power to the ESP 15 is activated, the pump is operating and fluid is entering the Y-tool through limb 12. The tapped electrical power to the motor 22 activates the motor to turn shaft 21 to position the valve 20 over the bypass limb 13 to prevent fluid flow therethrough. This then prevents recirculation of fluid from the pump and thus insures that the fluid is directed into the tubing portion 11 and to the surface.

Figure 6:
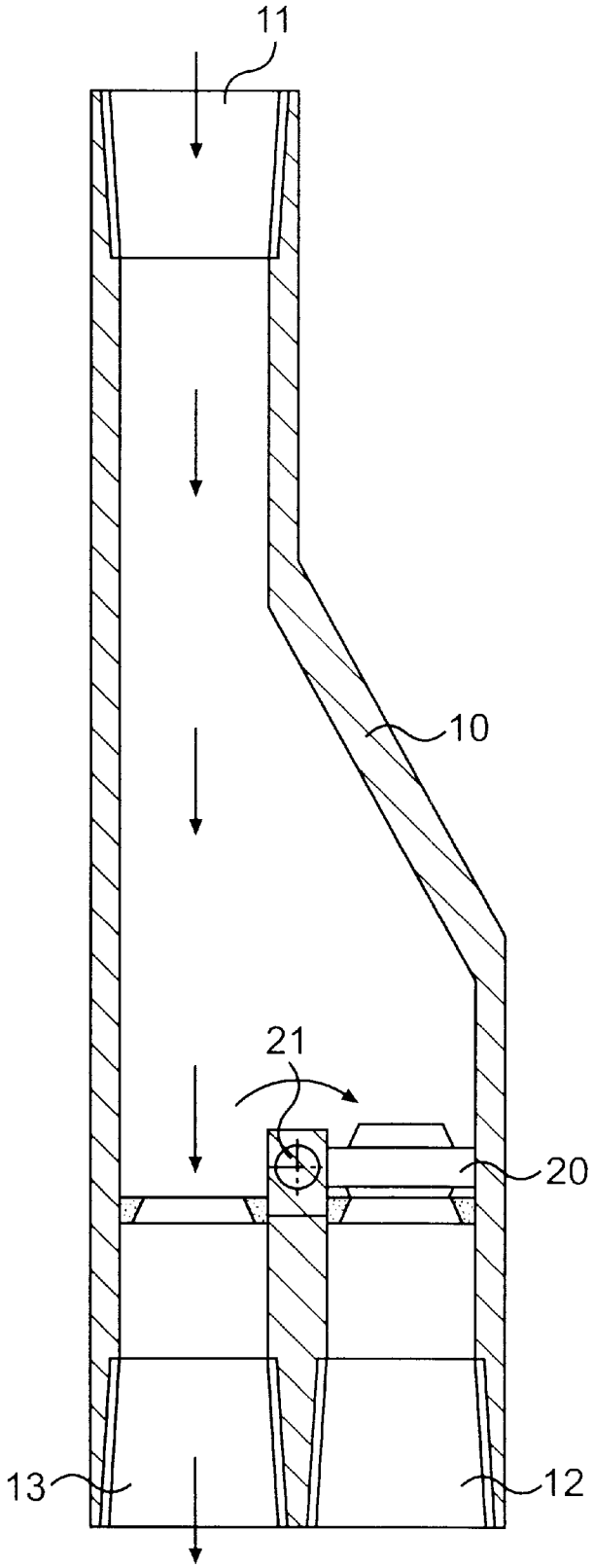
FIG. 6 is a view similar to FIG. 5 with the valve assembly positioned to close the limb in which the pump is located.

With reference to FIG. 6, when the electrical power to the ESP 15 is turned off, there will be no power directed to the motor 22. The valve 20 is then returned to the position shown in FIG. 6 to block leg 12 by the biasing action of a spring (not shown) or similar conventional biasing arrangement. In this position full access from the surface portion 11 of the tool through the limb 13 and into the bypass tubing 14 maybe obtained. This permits the use of intervention tools in the well bore below the ESP 15.

Figure 7:
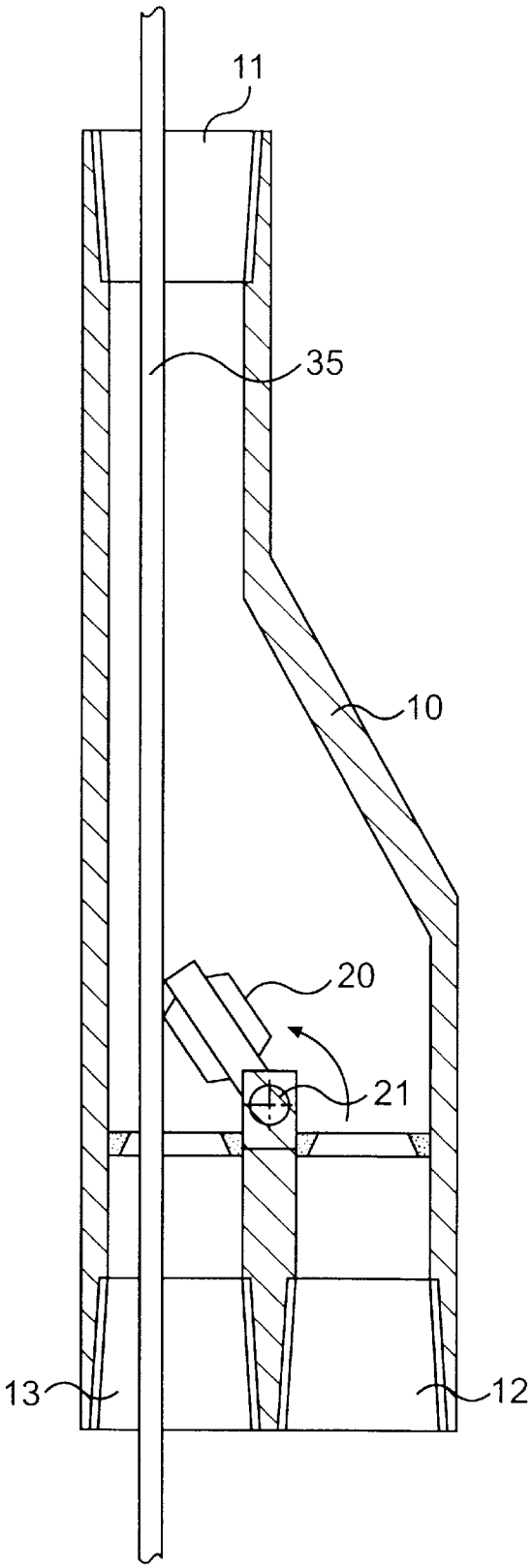
FIG. 7 is a cross sectional view showing the valve assembly positioned so that both limbs are open to product flow therethrough.

To facilitate operations wherein there is a need to access the well below the ESP 15 with intervention tools with the ESP 15 operating, the drive from the device 22 to the shaft 21, as shown in FIG. 7, has a clutch or similar drive interruption mechanism (not shown) which allows for the directional valve to travel only part way and abut against the intervention medium, which may be coiled tubing or a wire line designated as 35.

What is claimed is:

1. A control device for regulating flow of fluid selectively with respect to two passages of a completion tool positioned within well bore tubing, comprising:

said completion tool having a first passage in which an electrical submersible pump is positioned to pump fluid through said first passage to a surface portion of said completion tool through which said fluid passes to said well bore tubing and to a surface end thereof;

said completion tool having a second passage connected to said surface portion of said completion tool which second passage bypasses said first passage and said pump; and a valve having an electric motor for selectively closing said second passage to fluid flow therethrough when said pump is pumping fluid through said first passage to said surface portion and simultaneously opening said first passage to fluid flow therethrough, and opening said second passage to fluid flow therethrough when said pump is not pumping said fluid and simultaneously closing said first passage to fluid flow therethrough, whereby said pump may be bypassed through said open second passage to gain access to the well bore tubing below said pump.

2. The control device of claim 1, wherein said valve includes a rotatable shaft to which said means for selectively closing said second passage and opening said first passage, and selectively opening said second passage and closing said first passage is connected.

3. The control device of claim 2, wherein said means for selectively closing said second passage and opening said first passage, and selectively opening said second passage and closing said first passage includes a plate connected to said rotatable shaft and adapted for alternate and selective sealing engagement with said first passage and said second passage for closure thereof to fluid flow therethrough.

4. The control device of claim 3, wherein said rotatable shaft is connected to said electric motor for rotation thereof.

5. The control device of claim 4, wherein said electric motor and said pump are electrically connected to a common electrical power source.

6. The control device of claim 3, wherein means are provided for moving said plate to a position where both said first passage and said second passage are simultaneously open.

7. The control device of claim 1, wherein said valve includes means for opening both said first passage and said second passage simultaneously.

* * * * *